United States Patent [19]

Anthes et al.

[11] Patent Number: 5,040,790

[45] Date of Patent: Aug. 20, 1991

[54] APPARATUS FOR PACING

[75] Inventors: Robert G. Anthes, Omaha; Arthur J. Miller, Bellevue; Cecil D. Dewitt, Omaha, all of Nebr.

[73] Assignee: Swingpacer Corporation, Omaha, Nebr.

[21] Appl. No.: 285,194

[22] Filed: Dec. 16, 1988

[51] Int. Cl.[5] ..... A63B 69/36

[52] U.S. Cl. ..... 273/446; 273/186 R; 273/183 R; 273/35 R; 434/252; 434/258

[58] Field of Search ..... 273/1 GE, 1 GC, 186 R, 273/186 A, 186 B, 183 R, 186 C, 35 R, 55 R, 1 E; 434/258, 252, 257, 251; 368/108, 109, 110; 84/484

[56] References Cited

U.S. PATENT DOCUMENTS

| | | | |
|---|---|---|---|
| 3,675,243 | 7/1972 | Landuyt | 340/384 |
| 3,700,238 | 10/1972 | Mathis | 273/55 R |
| 3,772,800 | 11/1973 | Seze | 35/29 |
| 3,882,480 | 5/1975 | Greber | 340/323 |
| 3,895,366 | 7/1975 | Morris | 273/186 R |
| 4,014,167 | 3/1977 | Hasegawa et al. | 58/130 |
| 4,193,257 | 3/1980 | Watkins | 84/484 |
| 4,218,874 | 8/1980 | Ishida et al. | 84/484 |
| 4,285,041 | 8/1981 | Smith | 364/415 |
| 4,405,241 | 10/1983 | Aiham et al. | 368/109 |
| 4,442,752 | 4/1984 | Tsuchiya | 84/484 |
| 4,510,485 | 4/1985 | Tahara | 358/108 |
| 4,577,868 | 3/1986 | Kiyonaga | 273/183 |
| 4,583,738 | 4/1986 | Fava | 273/186 C |
| 4,627,620 | 12/1986 | Yang | 273/1 GE |
| 4,733,593 | 3/1988 | Rothbart | 84/484 |

FOREIGN PATENT DOCUMENTS

| | | | |
|---|---|---|---|
| 2179777 | 3/1987 | United Kingdom | 273/1 GC |

*Primary Examiner*—Benjamin Layno
*Assistant Examiner*—Jessica J. Harrison
*Attorney, Agent, or Firm*—Zarley, McKee, Thomte, Voorhees & Sease

[57] ABSTRACT

The swingpacer of the present invention is comprised of a power source, integrated electrical circuitry and a speaker which is housed in a suitable cabinet. A separate operable control functions as a mode select which cooperates with the electrical circuitry associated therewith to produce the desired number of tones, with the electrical circuitry including a control of operatively permitting the user to control the time delay between audible signals and to control the duration thereof. Additionally, the electrical circuitry includes a control which permits the user to operably control the time delay between the last audible signal of the previous sequence and the initiation of a new sequence of audible signals. The electrical circuitry is capable of generating a short audible signal prior to the starting of the next sequence which functions as an alert to the upcoming sequence. Additionally, for each audible signal that is generated, there is a registering visual signal emitted from an LED which is operatively connected to the electrical circuitry.

7 Claims, 3 Drawing Sheets

APPARATUS FOR PACING

Technical Field

This invention relates generally to a pacing timer and more specifically to an improved pacing timer or swing-pacer for use in assisting, developing and maintaining multi-stepped synchronized bodily movements such as in golf or the like.

BACKGROUND OF THE INVENTION

Athletic endeavors such as golf, bowling, tennis and dancing require the use of multi-stepped synchronized movements to achieve a particular result. The level of success that an individual will experience in the particular athletic endeavor is directly affected by the ability of the person to repetitively and uniformly reproduce the necessary movements with the proper timing. A device which can provide an audible and visual signal which accurately represents the timing of the multiple steps required to perform complex activities such as golf, bowling and the like would greatly aid in developing and maintaining the appropriate timing for that endeavor.

For example, a golfer, during the off-season in the northern latitudes, must practice indoors. The indoor golfer will soon begin to rush the backswing and downswing for the flight of the ball is no longer observable. The flight of the ball is what is used to determine if the ball is being struck correctly. However, a pacing timer which accurately reflects the proper timing of the steps being used would insure that a golfer would be less likely to speed up the swing during the off-season. Thus, a device which can assist in synchronizing and maintaining complex movements could serve both as a training tool and a diagnostic aid for a trainer and/or user.

Today, there are a number of training tapes which have been created by professional athletes. These training tapes demonstrate the proper methods and timing, but the individual has no tool with which to precisely duplicate the timing being utilized. A pacing timer which allows the individual to set the identical timing sequence, which is being utilized by the athlete in the training tape, would give the user an audible and visual means of reinforcing the tape's teachings.

While there are number of devices being utilized as pacers to assist in synchronizing bodily movements, they all suffer from several drawbacks. One limitation of the prior art devices is they are unable to produce the desired number of sequential tones or sounds required for the particular sport. Further, the prior art devices do not permit the user to selectively adjust the length of the sounds or the delay time between the sounds thereby severely limiting the usefulness and adaptability of the devices.

One such prior art device is U.S. Pat. No. 4,577,868 to Kiyonaga which is specifically utilized for golf swing training and has both visual and audible alerts.

The audible alert of the '868 patent consists of three timed chimes which are initiated by one of two address plates, each having weight sensors to detect and register the appropriate shifting of weight by a golfer during execution of a golf swing. Only the time interval between the first and second chimes can be adjusted in the '868 device. Further, the duration of each chime is not adjustable. Thus, the '868 device is not believed to be adaptable to accommodate different types of synchronized bodily movements having different timing between each movement thereof.

Another prior art device is U.S. Pat. No. 3,882,480 to Gerber which is a contact pace timer which may be worn by an individual and which generates an audible signal. Although the timing between the audible signals can be adjusted by the individual, the '480 device does not permit the generation of sequential, multiple tones having selectively adjustable timing. Additionally, the user of the '480 device must manually select the new timing sequence prior to the next cycle.

It is therefore a principal object of the present invention to provide an improved electronic pacing timer which can be utilized by different users for different synchronized multi-stepped bodily movements.

Another object of the present invention is to provide a pacer of the type described which permits the user to set multiple, independent tones which are generated at appropriate times and intervals.

Still a further object of the present invention is to provide a pacer which can serve as a diagnostic tool to aid in the development of proper athletic techniques.

Another object of the invention is to provide a pacer which allows the user to set the pace or timing thereof according to that which is utilized by those who are highly successful in a particular activity.

A further object of the present invention is to provide a pacer which is readily adaptable to accommodate different synchronized movements and the differing requirements for each user.

This and other objects of the invention will be readily apparent to those skilled in the art.

SUMMARY OF THE INVENTION

The swingpacer of the present invention is comprised of a power source, integrated electronic circuitry and a speaker which is housed in a suitable housing. A separate operable control functions as the mode select which cooperates with two decade counters, three NAND gates, four clocks, four diodes, one transistor, a tone amp and a low power amp to produce the desired number of tones. Each clock is operably and individually controlled, thereby permitting the selective adjustment of the time delay between the preceding audible signal and the subsequent audible signal. Additionally, the controlling of the clocks permits the selective control of the audible signal's duration. The first clock operably controls the time delay between the first and second audible signals and the duration of the signals. The second clock operably controls the time delay between the second and third audible signals and the duration of the third signal. The third clock operably controls the duration of the fourth audible signal and the time delay between the third and fourth audible signals. The fourth clock establishes the delay between the last audible signal produced and the initiation of a new sequence of audible signals. Furthermore, the fourth clock generates a short audible signal that is generated prior to the initiation of the next sequence and functions as an alert. Additionally, the device includes a visual signal emitted by a Light Emitting Diode (LED) corresponding to the audible signals.

DESCRIPTION OF THE PREFERRED EMBODIMENT

Figure 1:
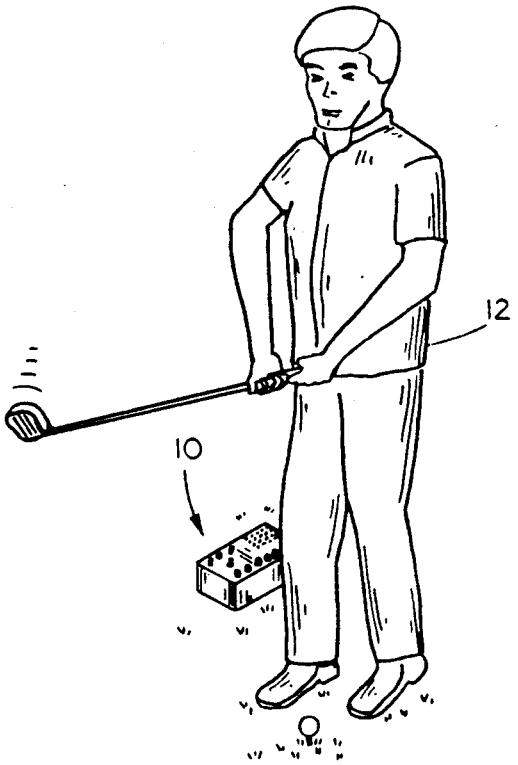
FIG. 1 is a perspective view illustrating a golfer using the swingpacer of the present invention.

Referring now to the drawings in which similar or corresponding parts are identified by the same reference numeral, the swingpacer of this invention is generally referred to by the reference numeral 10 while the numeral 12 refers to a golfer utilizing the invention to time his swing.

Figure 2:
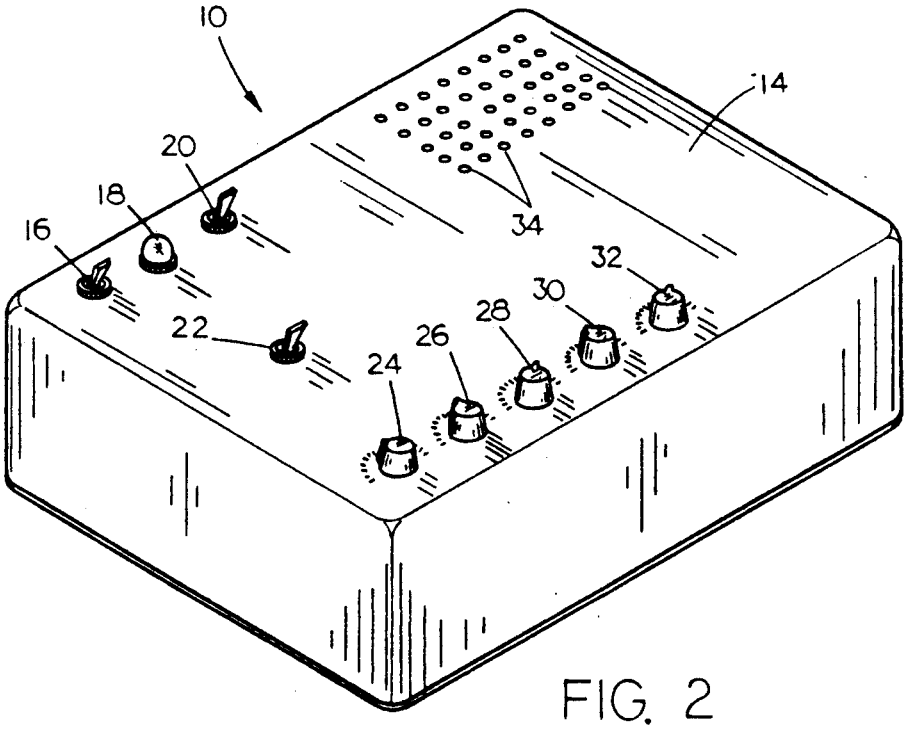
FIG. 2 is a perspective view of the present invention.

Referring now to FIG. 2, the swingpacer 10 includes an outer housing 14 which supports manually operable controls 16, 20, 22, 24, 26, 28, 30, 32, LED 18 and a speaker grill 34. The on/off switch 16 and the operate/reset switch 20 preferably comprise two-position toggle switches. Switch 22 is a manually operable three-position toggle switch which functions as a mode select switch to permit the user to select whether two, three or four tones are to be produced by the apparatus during each sequence or cycle.

Rotary dial 24 permits operable adjustment of the volume of the audible signals produced by the apparatus. The time delay between the first and second audible signals and the duration of each audible signal is operably controlled by a second rotary dial 26. The duration of the third audible signal and the time delay between the second and third audible signals are controlled by rotary dial 28. A fourth rotary dial 30 permits adjustment of the time delay between the third and fourth audible signals and the duration of the fourth audible signal. Rotary dial 32 permits selective adjustment of the time delay between the last audible signal and the beginning of a new sequence of audible signals.

Figure 3:
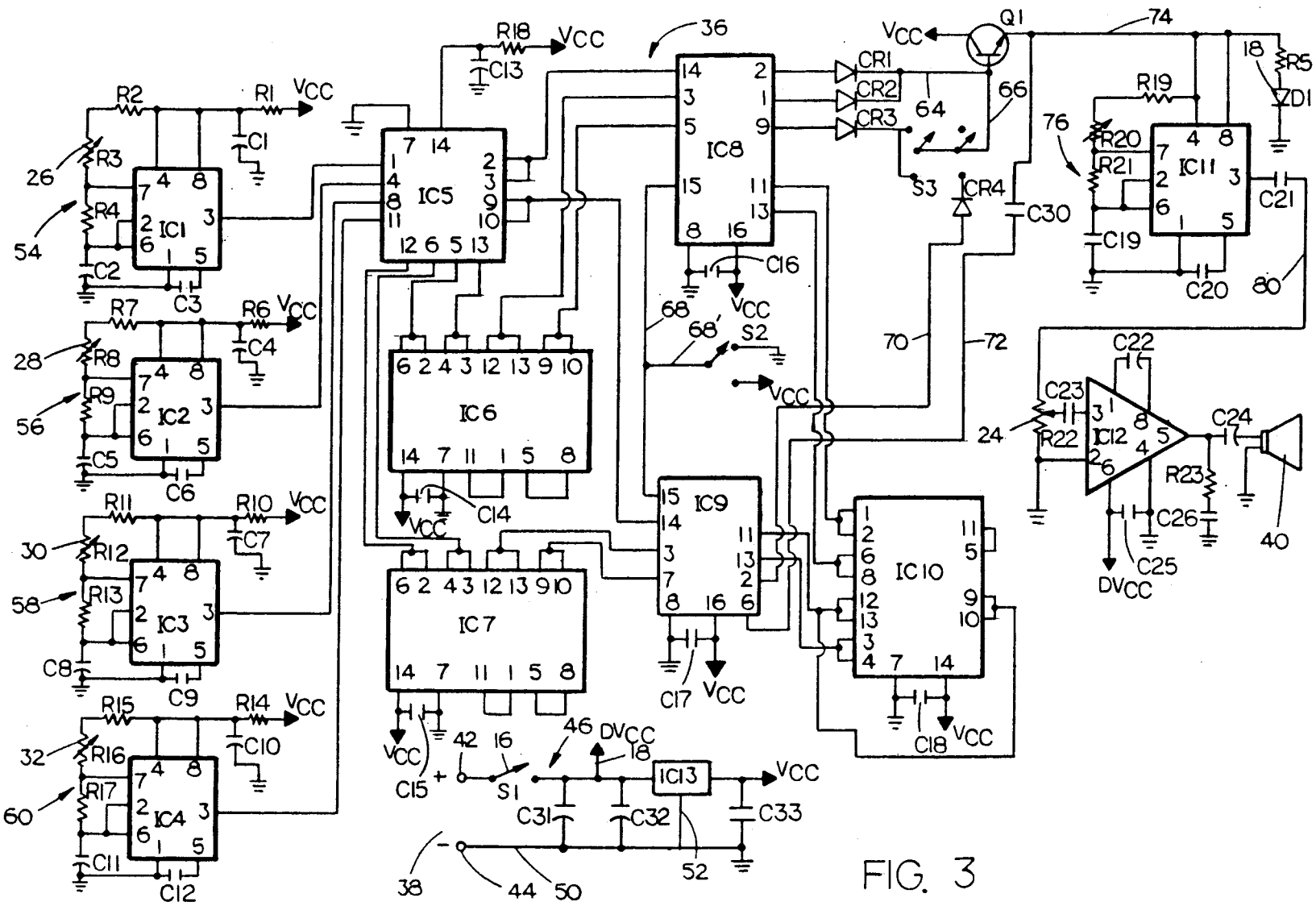
FIG. 3 is a detailed, electrical schematic of the present invention.

As seen in FIG. 3, a conventional printed circuit board 36 provides support for the electronic circuitry, power supply 38, and speaker 40. Table 1 reproduced hereinbelow details the preferred types and specifications of Integrated Circuits (IC's) and the values for the resistors, capacitors and other electrical components preferably utilized in the electronic circuitry of this invention. Unless otherwise noted, the term "conductor" refers to those types of conductors or leads which are used in printed circuit boards and the like to electrically connect the various electronic components thereof.

TABLE 1

| | | |
|---|---|---|
| Resistors | | |
| R23 | 10 Ω | ¼ W |
| R1, R6, R10, R14, R18, R21 | 100 Ω | ¼ W |
| R4, R9, R13, R17 | 500 Ω | ¼ W |
| R2, R5, R7, R11, R15, R19 | 1000 Ω | ¼ W |
| R3, R8, R12, R16, R20, R22 | 30K Ω | POTT |
| Capacitors | | |
| C3, C6, C9, C12, C20 | .01 μF | |
| C14, C15, C16, C17, C18, C23, C25, C26, C30, C33 | .1 μF | |
| C32 | .470 μF | |
| C19 | 1 μF | |
| C21, C22 | 10 μF | 16 VDC |
| C24 | 25 μF | |
| C1, C4, C7, C10, C13 | 100 μF | 16 VDC |
| C27 | 500 μF | 16 VDC |
| C2, C5, C8, C11 | 60 μF | 16 VDC |
| Diodes | | |
| D1 | RED LED | |
| CR1, CR2, CR3, CR4 | 1N914 | |
| Transistors | | |

TABLE 1-continued

| | | |
|---|---|---|
| Q1 | 2N2222 | |
| Speaker | 8 ohm impedance | |
| Switch | | |
| S1, S2 | SPST | |
| S3 | DPDT | 3 positions on-off-on |
| ICS | | |
| IC1, IC2, IC3, IC4, IC11 | LM555 | |
| IC5 | 4066 | |
| IC6, IC7, IC10 | 7400 | |
| IC8, IC9 | 4017 | |
| IC12 | LM386 | |
| IC13 | 7805 | |

The power source 38 for the apparatus is preferably a nine volt battery having a positive terminal 42 and a negative terminal 44 which are operatively electrically connected to conductors 46 and 50 respectively. Conductor 46 comprises a multi-segmented conductor which operatively connects the positive terminal 42 of battery 38 to one terminal of the on/off switch S1, and connects the opposing terminal of switch S1 to the output terminal VCC with IC13 interposed therebetween. Conductor 50 operatively connects capacitor C33 to conductor 46 between IC13 and output terminal VCC. Capacitor C31 and C32 are connected in series to conductors 46 and 50 as illustrated in FIG. 3. The DVcc is connected to conductor 46 between capacitors C31 and C32 by conductor 48. IC13 is connected to conductor 50 by conductor 52 between capacitors 32 and capacitors 33.

Pin 3 of clock IC1 is connected to pin 1 of electronic switch IC5 as seen in FIG. 3. A resistor capacitor network is connected by a multi-segmented conductor 54 to pins 1, 2, 4, 5, 6, 7, 8 and the VCC as described hereinbelow. Capacitor C3 is connected in parallel across pins 1 and 5 and to the grounded portion of capacitor C2. The opposing end of capacitor C2 is connected by conductor 54 in series to resistor R4. Pins 2 and 6 are joined with the combined output thereof being connected to conductor 54 between capacitor C2 and resistor R4. Resistor R4 is connected by capacitor 54 to variable resistor R3, which is operatively connected to and controlled by rotary dial 26. Pin 7 is connected to conductor 54 between resistor R4 and variable resistor R3. Variable resistor R3 is connected in series to resistor R2 by conductor 54 with resistor R2 being connected in series to R1 by conductor 54. Resistor R1 is connected by conductor 54 to the VCC. Pins 4 and 8 are separately connected to conductor 54 between resistors R1 and R2 as seen in FIG. 3. Capacitor Cl is connected between resistor R1 and pin 8 to conductor 54 with the opposing end thereof being grounded.

Resistors R2 and R4, in conjunction with variable resistor R3 and capacitor C2, cooperate with IC1 to control the frequency of pin 3's output between 1 hz and 100 khz. Furthermore, resistor R4 cooperates with clock IC1 to control the width of the pulse being emitted from pin 3. Thus it can be seen that by operably adjusting the resistance of variable resistor R3, the time delay between pulses may be operably adjusted and the duration of the emitted audible signal may be controlled.

As seen in FIG. 3, pin 3 of clock IC2 is connected to pin 4 of electronic switch IC5. A resistor capacitor network is connected by a multi-segmented conductor 56 to pins 1, 2, 4, 5, 6, 7, 8 and the VCC as described in further detail hereinbelow. Capacitor C5 is connected in parallel across pins and 5. Conductor 56 connects capacitor C6 and pin to the grounded portion of capacitor C5. The opposing end of capacitor C5 is connected in series to resistor R9 by conductor 56. Pins 2 and 6 are joined with the combined output thereof being connected to conductor 56 between capacitor C5 and resistor R9. Conductor 56 connects resistor R9 in series to variable resistor R8, which is connected to and operably controlled by rotary dial 28. Pin 7 is connected to conductor 56 between resistor R9 and variable resistor R8. Variable resistor R8 is connected by conductor 56 to resistor R7 and resistor R7 is serially connected to resistor R6 by conductor 56. Resistor R6 is connected by conductor 56 to the VCC. Pins 4 and 8 are separately connected to conductor 56 between resistors R7 and R6. A capacitor C4 is connected between resistor R6 and pin 8 to conductor 56 with the opposing end thereof being grounded.

The output from pin 3 of clock IC2 is controlled in the same manner as that discussed with regard to IC1. Clock IC2 controls the electronic pulse which is utilized in the production of the third audible signal and the time delay between the second and the third audible signals.

Clock IC3, as illustrated in FIG. 3, has pin 3 connected to pin 8 of electronic clock IC5. A multi-segmented conductor 58 connects a resistor capacitor network to pins 1, 2, 4, 5, 6, 7 and 8 to the VCC as described hereinbelow. Capacitor C9 is connected to pins 1 and 5. Pin 1 and capacitor C9 are connected in series to the grounded portion of capacitor C8 by conductor 58. The opposing end of capacitor C8 is connected in series to resistor R13 by conductor 58. Pins 2 and 6 are joined with the combined output thereof being connected to conductor 58 between capacitor C8 and resistor R13. Resistor R13 is connected in series by conductor 58 to variable resistor R12, which is operably connected to and controlled by rotary dial 30. Pin 7 is connected to conductor 58 between resistor R13 and variable resistor R12. Variable resistor R12 is connected in series to resistor R11 by conductor 58 with the opposing end thereof being connected in series to resistor R10 by conductor 58. Resistor R10 is connected to the VCC by conductor 58. Pins 4 and 8 are individually connected to conductor 58 as seen in FIG. 3. Capacitor C7 is connected to conductor 58 between resistor R11 and pin 10 with the opposing end thereof being grounded.

The output of pin 3 of clock IC3 is controlled in the same manner as described relative to the discussion of clocks IC1 and 2. The output from clock IC3 establishes the duration of the fourth audible signal and the time delay between the third and fourth audible signals.

Pin 3 of clock IC4 is connected to pin 11 of electronic switch IC5. A resistor capacitor network is connected by a multi-segmented conductor 60 to pins 1, 2, 4, 5, 6, 7, 8 and the VCC as described hereinbelow. Capacitor C12 is connected in parallel to pins 1 and 5. Capacitor C12 and pin 1 are connected by conductor 60 to capacitor C11's grounded portion. The opposing end of capacitor C11 is connected in series to resistor R17 by conductor 60. Pins 2 and 6 are joined with the combined output thereof being connected to conductor 60 between capacitor C11 and resistor R17. Conductor 60 connects resistor R17 in series to variable resistor R16, which is operatively and adjustably controlled by rotary dial 32. Pin 7 is connected to conductor 60 between resistor R17 and variable resistor R16. Variable resistor R16 is connected in series to resistor R15 by conductor 60. Resistor R15 is connected in series to resistor R14 by conductor 60. Resistor R14 is connected by conductor 60 to the VCC. Pins 4 and 8 are connected to conductor 60 between resistors R14 and R15 as illustrated in FIG. 3. Capacitor C10 is connected to conductor 60 between resistor R14 and pin 8 with the opposing end thereof being grounded.

The output of pin 3 from clock IC4 is controlled in the same manner as described relative to the discussion of clocks IC1, 2 and 3. The output from clock IC4 determines the time delay between the last audible signal produced and the start of a new sequence of tones. Additionally, clock IC4 controls the production of the alert signal.

Pin 7 of electronic switch of IC5 is grounded. Pin 14 is connected in series to resistor R18 by conductor 62. Capacitor C13 is connected to conductor 62 between pin 14 and resistor R18 with the opposing end thereof grounded. The VCC is connected to resistor R18 by conductor 62. Pins 2 and 3 are joined and connected to pin 14 of IC8. Pins 9 and 10 are connected to pin 14 of decade counter IC9. Pin 13 is connected to pins 4 and 3 of NAND gate IC6. Pin 5 is connected to pin 6 and 2 of NAND gate IC6. Pin 6 is connected to pins 4 and 3 of NAND gate IC7. Pin 12 is connected to pin 6 and 2 of NAND gate IC7.

As illustrated in FIG. 3, NAND gate IC6 has pins 12 and 13 connected to pin 3 of decade counter IC8. Pins 9 and 10 are connected to pin 5 of decade counter IC8. Pins 5 and 8 are joined together. Pins 11 and 1 are connected together. Pin 7 is grounded and pin 14 is connected to the VCC. Capacitor C14 is connected in parallel between pins 14 and 7.

As shown in FIG. 3, NAND gate IC7 has pins 12 and 13 connected to pin 3 of decade counter IC9. Pins 9 and 10 are connected to pin 7 of decade counter IC9. Pins 5 and 8 are joined. Pins 11 and 1 are joined together. Pin 7 is grounded and pin 14 is connected to the VCC. A capacitor C15 is connected in parallel to pins 7 and 14.

Pin 2 of decade counter IC8 is connected in series to diode CR1. Pin 1 is connected to diode CR2. The output of diodes CR1 and CR2 are connected to conductor 64. Conductor 64 is connected to conductor 66 as illustrated in FIG. 3. Pin 9 of decade counter IC8 is connected to diode CR3 with the output thereof being connected to two of the terminals of switch S3, which is operatively connected to and controlled by switch 22, the mode select. Pin 11 is connected to pins 1 and 2 of NAND gate IC10. Pin 13 is connected to pin 6 and 8 of NAND gate IC10. Pin 16 is connected to the VCC and pin 8 is grounded. A capacitor C16 is connected in parallel to pins 16 and 8. Pin 15 is connected to pin 15 of decade counter IC9 by conductor 68. Switch S2 which is operatively connected to and controlled by the operate/reset switch 20 has one terminal thereof connected to conductor 68 by conductor 68'. Switch S2 has one terminal thereof grounded with the other terminal being connected to the VCC as shown in FIG. 3.

The decade counter IC9, as illustrated in FIG. 3, has pin 11 connected to pins 12, 13, 9 and 10 of NAND gate IC10 Pin 13 is connected to pins 3 and 4 of NAND gate IC10. As illustrated in FIG. 3, pin 2 is connected by conductor 70 to a terminal of switch S3 with diode CR4 being interposed therebetween. Pin 6 is connected in series to capacitor C30 by conductor 72. Capacitor C30 is connected to conductor 74 by conductor 72. Pin 16 is connected to the VCC and pin 8 is grounded. A capacitor C17 is connected in parallel to pins 8 and 16.

The NAND gate IC10 has pins 11 and 5 joined. Pin 14 is connected to the VCC and pin 7 is grounded. A capacitor C18 is connected in parallel to pins 7 and 14.

The NPN transistor Q1 has one terminal connected to the VCC, with another terminal thereof being connected to conductor 66. The output terminal of NPN transistor Q1 is connected to conductor 74. Conductor 74 is connected to resistor R5. Resistor R5 has the opposing end thereof connected to a ground by conductor 74 with diode D1 (LED 18) being interposed thereon. Pins 4 and 8 of tone amp IC8 are connected to conductor 74 as shown in FIG. 3.

Pin 3 of tone amp IC11 is connected in series to capacitor C21 by conductor 80. A resistor-capacitor network 76 is connected by a multi-segmented conductor 60 to pins 1, 2, 4, 5, 6 and 7 to pin 4 as described in further detail hereinbelow. Pins 1 and 5 are connected in parallel to capacitor C20. Pin 1 and capacitor C20 are connected to the grounded portion of capacitor Cl by conductor 76. Capacitor C19 is connected by conductor 76 to resistor R21. Pins 2 and 6 are joined with the combined output thereof being connected to conductor 76 between capacitor C19 and resistor R21. Resistor R21 is connected in series to variable resistor R20 by conductor 76, which permits operable control of the audible signal's pitch to be emitted by speaker 40. Variable resistor R20 is connected to R19 by conductor 76 and resistor R19 is connected to pin 4 by conductor 76.

Conductor 80, in addition to connecting capacitor C21 to pin 3 of tone amp IC11, connects capacitor C21 to variable resistor R22, which is operatively connected to and controlled by rotary dial 24. The opposing end of resistor R22 is connected by conductor 82 to a ground. Pin 2 of the low power amp IC12 is connected to conductor 80 between variable resistor R22 and the ground.

Capacitor C23 connects in series pin 3 of the lower power amp IC12 to variable resistor R22. Pins 1 and 8 are connected in parallel to capacitor C22. Pin 5 is connected to capacitor C24. Capacitor C24 has the opposing end thereof connected to speaker 40. Speaker 40 has the other terminal grounded. Between pin 5 and capacitor C24, a resistor R23 is connected in parallel with the opposing end thereof being connected in series to capacitor C26. Capacitor C26 has one end thereof grounded. Pin 4 is grounded and pin 6 is connected to the DVcc. A capacitor C25 is connected in parallel to pins 4 and 6.

Figure 4:
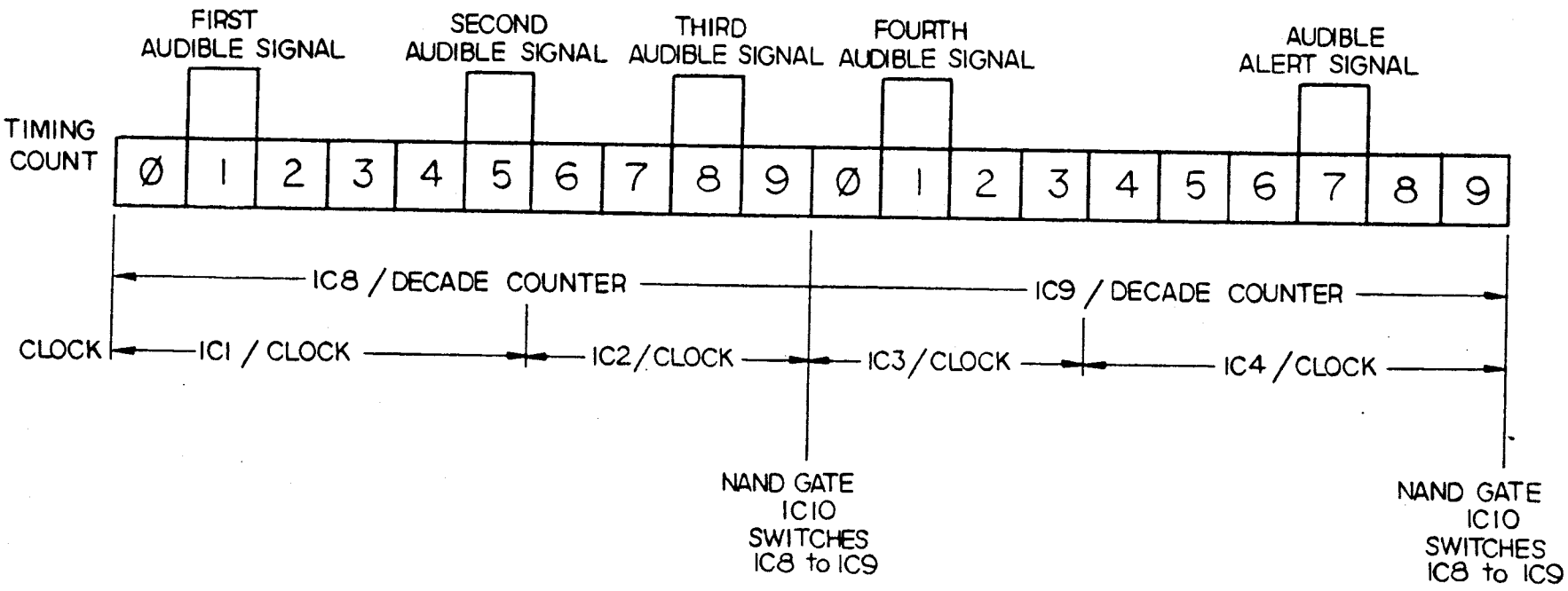
FIG. 4 is a timing chart.

Each decade counter IC8 and 9 produces a ten count timing count beginning with time zero and ending at time nine. FIG. 4 illustrates the relationship between the timing counts of decade counters IC8 and 9, NAND gate IC10, clocks IC1, 2, 3 and 4 and the audible signals produced. FIG. 4 will be discussed in more detail hereinbelow.

The user begins the operations of the present invention by turning the power on using the on/off switch 16. The user then selects either two, three or four tones to be produced by using the mode select switch 22. After the selection of the tones has been made, the operate/reset switch 20 is placed in the operating position. Pins 15 of both decade counters IC8 and 9 respectively go low when the operate/reset switch 20 is placed in the operating position. Both decade counters IC8 and 9 will start counting. Decade counter IC8 immediately turns off decade counter IC9 and then begins its routine.

All four clocks, IC's 1, 2, 3, and 4, run continuously. Each clock is individually controlled as discussed hereinabove for adjusting the time delay between audible signals and the duration of the emitted audible signal.

The enabled decade counter IC8 will begin counting from zero to nine. At time zero, pin 3 of IC8 will send a high to pins 12 and 13 of NAND gate IC6. This causes pin 3 to go high thereby forcing pin 13 of electronic switch IC5 to go high. Contacts 1 and 2 of electronic switch IC5 close and thus permit input into pin 14 of decade counter IC8.

At time one, pin 2 of decade counter IC8 will output a high to diode CR1 which turns on NPN transistor Q1. Power is supplied by the VCC to tone amp IC11 and diode D1 when NPN transistor Q1 is turned on. The tone amp IC11 will supply the first audible signal which is passed through the volume control 24 to the low power amp IC12 with a subsequent audible signal being emitted by speaker 40. In addition to the audible signal being produced, LED 18 simultaneously produces a registering visual signal.

At time five, decade counter IC8 will output a high to diode CR2 which turns on NPN transistor Q1 as explained hereinabove and the second audible signal and visual signal are generated.

At time six, pin 5 of decade counter IC8 will go high thereby causing pins 9 and 10 of NAND gate IC6 to go high. Through the NAND gate configuration of IC6, pin 6 will go high and pin 3 will go low. This causes the electronic switch IC5 to open pins 1 and 2 and close pins 3 and 4 respectively. This permits the output of clock IC2 to be fed into pin 14 of decade counter IC8.

At time eight, pin 9 of IC8 will go high turning on diode CR3. A third audible signal and accompanying visual signal will be generated as described hereinabove, if the mode select switch 22 is in the three-tone position.

At time nine, pin 11 of decade counter IC8 will go high thereby causing pins 1 and 2 of NAND gate IC10 to go high. This will force pin 6 to go high and send a high back to decade counter IC8 which is subsequently turned off. Simultaneously, through the NAND gate configuration, pin 3 of NAND gate IC10 will send out a low. This low causes pin 13 of decade counter IC9 to go low thereby turning on decade counter IC9.

With the decade counter IC9 enabled, the user is given control over the fourth audible signal and the time delay between the last tone produced. The resumption of the sequence will produce an alert signal. The decade counter IC9 begins a zero through nine count as did decade counter IC8.

At time zero, pin 3 of decade counter IC9 will send a high to pins 12 and 13 of NAND gate IC7. This causes pin 3 to go high thereby placing a high on pin 6 of electronic switch IC5.

This permits electronic switch IC5's contacts 8 and 9 to close. This begins the clocking and input into pin 14 of decade counter IC9.

At time one, pin 2 of decade counter IC9 will output a high to diode CR4 thereby providing a fourth audible signal to be emitted if the mode select switch 22 is properly set. The production and control of the audible and visual signal are the same as described hereinabove.

At time three, pin 7 of decade counter IC9 will go high thereby causing pins 9 and 10 of NAND gate IC7 to go high. Through the NAND gate configuration of IC7, pin 12 will go high and pin 6 will go low. This causes contacts 11 and 10 of electronic switch IC5 to close and permits clock IC4's input to be fed into pin 14 of decade counter IC9.

At time seven, an output high will be fed to IC11, the tone amp, and will supply power for a sufficient length of time to cause a very short audible signal to be generated from the speaker. The very short audible signal functions as an alert signal to inform the individual that a new repetition of audible signals is forthcoming.

At time nine, a high will be fed to pins 12 and 13 of NAND gate IC10 thereby feeding a high back to pin 13 of decade counter IC9. Decade counter IC9 is turned off. This low is also fed to pin 13 of decade counter IC8 and restarts a new sequence of audible tones.

Each of the four clocks, IC's 1, 2, 3, and 4, run continuous while the two decade counters IC8 and IC9 flip flop back and forth with only one decade counter being active at any one time. The NAND gate circuitry of IC's 6, 7 and 10 turn the electronic switch of IC5 on and off and thus gives the two, three or four audible signal output and an alert signal.

It is understood that microprocessors and other suitable electronic circuitry can be substituted for the circuitry utilized herein. Furthermore, more than four tones can be generated when additional decade counters, NAND gates and clocks are added to the present configuration. The present invention is not limited to producing a maximum of four sequential tones.

For example, a golfer would utilize the present invention in the following manner. The operate/reset switch 20 would be placed in the reset position. The on-off switch would then be placed into the on position and the operate/reset switch to the operate position. The user would then use the mode select switch 22 to select the desired number of tones. The user would then adjust rotary dial 24 to set the volume to the desired level. The first rotary dial 26 will be used to adjust the time delay between the first and second audible signals to be produced and the length that the audible signals will be emitted by the speaker 40. For golf, the alert signal is produced and alerts the user to assume the address position. The first audible tone emitted would correspond to the golfer being in the take-away position. The time delay between the first and second audible tones would indicate the time that the golfer is utilizing in the backswing with the second tone indicating the cessation of the backswing and the initiation of the downswing. The user then adjusts the third rotary dial 28 to establish the time interval between the second and third audible tones emitted from speaker 40 and the length of time that the third audible signal will be heard. The time delay between the second and third audible tones corresponds to the amount of time required to complete the downswing with the third audible tone corresponding to impact or the finish of the golf swing. The time delay between the third and fourth signals and the length of time that the fourth signal will be heard is controlled by rotary dial 30, but in this example does not have application in the golf swing. Finally, the user adjusts the fifth rotary dial 32 to reflect the amount of time delay that is desired between the initiation of a new sequence of tones and allows the golfer time to prepare for another practice shot.

Once all of the user controls are placed in the correct position, the user then is ready to utilize the device. The user places the device sufficiently nearby so as to be able to hear the setup signals and audible tones emitted. The user then begins to practice the golf swing utilizing the swingpacer 10 to appropriately time the various synchronized bodily movements utilized to properly execute a golf shot. The device is not designed to be carried on or attached to the user.

It can thus be seen that the present invention accomplishes all of the above stated objectives.

We claim:

1. An improved pacing timer comprising, a housing means, electrical circuit means in said housing means, a plurality of user operable controls mounted on said housing means for the selective control of components of the electrical circuit means, an audible signal means operatively connected to said electrical circuit means for generating a plurality of sequences of audible tones, a power source for said electrical circuit means and said audible signal means, said electrical circuit means including an operable means for selecting the number of sequential tones to be emitted by said audible signal means in each sequence, said means for selecting the number of tones adapted to permit the selection of at least two separate sequential tones, means for selectively and independently controlling the time duration between the audible tones emitted by said audible signal means, and for controlling the duration of each tone, said means for controlling the duration of the tones and for controlling the duration of time between tones, including:

first operable control means for selecting the duration of a first and second audible tone and the duration of time therebetween, second operable control means for selecting the duration of a third audible tone and the duration of time between the second and third tones, and an audible signal which is generated at a predetermined time prior to the beginning of each subsequent sequence of tones.

2. The pacing timer of claim 1, wherein said means for controlling the duration of the tones and for controlling the duration of time between tones further comprises a third operable control means for selecting the duration of the fourth audible tone and the duration of time between the third and fourth tones.

3. The pacing timer of claim 1, wherein said means for controlling the duration of the tones and for controlling the duration of time between tones further comprises a fourth operable control means for selecting the time delay between the last audible tone of one sequence and the first tone in a subsequent sequence.

4. The pacing timer of claim 1 wherein a visual indicator means is mounted on said housing means, said visual indicator means being operatively connected to said electrical circuit means whereby a visual signal is produced corresponding to the audible tones being generated.

5. The pacing timer of claim 1, wherein an operable control means for controlling the pitch of the audible signal is operatively connected to said electrical circuit means for operably controlling the pitch of the audible signals being generated.

6. The pacing timer of claim 1 wherein an operable control means for adjusting the volume of said audible tones is operatively connected to said electrical circuit means which operably controls the volume of the audible signal being generated.

7. The pacing timer of claim 1 wherein an operable control means is operatively connected to said electrical circuit means for operably suspending the generation of audible tones.

* * * * *